US007013777B2

(12) United States Patent
Aalto et al.

(10) Patent No.: US 7,013,777 B2
(45) Date of Patent: Mar. 21, 2006

(54) NOZZLE UNIT FOR CUTTING BY MEANS OF LIQUID, AND METHOD FOR CUTTING USING SAME

(75) Inventors: Esa Aalto, Hyvinkää (FI); Kalevi Vesterinen, Vantaa (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/466,654

(22) PCT Filed: Feb. 7, 2002

(86) PCT No.: PCT/FI02/00089

§ 371 (c)(1),
(2), (4) Date: Jul. 17, 2003

(87) PCT Pub. No.: WO02/064469

PCT Pub. Date: Aug. 22, 2002

(65) Prior Publication Data

US 2004/0045420 A1 Mar. 11, 2004

(30) Foreign Application Priority Data

Feb. 9, 2001 (FI) ..... 20010243

(51) Int. Cl.
*B26F 3/00* (2006.01)

(52) U.S. Cl. ..... 83/53; 83/177

(58) Field of Classification Search ..... 83/177, 83/22, 53
See application file for complete search history.

(56) References Cited

U.S. PATENT DOCUMENTS

| | | | | |
|---|---|---|---|---|
| 3,877,334 | A | 4/1975 | Gerber | |
| 4,695,004 | A | 9/1987 | Grossmann et al. | |
| 5,842,664 | A | 12/1998 | Åkerlund | |
| 6,101,912 | A * | 8/2000 | Sanders et al. | 83/53 |
| 6,103,049 | A * | 8/2000 | Batdorf | 156/251 |
| 6,135,000 | A * | 10/2000 | Caspar et al. | 83/177 |
| 6,227,087 | B1 * | 5/2001 | Thorson et al. | 83/109 |
| 6,540,586 | B1 * | 4/2003 | Sciulli | 451/2 |
| 2002/0066345 | A1 * | 6/2002 | Shepherd et al. | 83/53 |

FOREIGN PATENT DOCUMENTS

| | | |
|---|---|---|
| CA | 2031802 | 5/1991 |
| EP | 0 543 788 A1 | 5/1993 |
| EP | 1 022 381 A2 | 7/2000 |
| FI | 88417 | 1/1993 |
| FI | 99283 | 1/1998 |
| WO | WO 91/03359 | 3/1991 |

* cited by examiner

*Primary Examiner*—Charles Goodman
(74) *Attorney, Agent, or Firm*—Cohen, Pontani, Lieberman & Pavane

(57) ABSTRACT

The device for cutting a paper web or the like is arranged to cut in such a manner that a liquid medium is sprayed via nozzles (3). The device comprises a nozzle unit (2) that is arranged movable and comprises a nozzle (3) and a high-pressure pump (4).

4 Claims, 3 Drawing Sheets

NOZZLE UNIT FOR CUTTING BY MEANS OF LIQUID, AND METHOD FOR CUTTING USING SAME

PRIORITY CLAIM

This is a U.S. national stage of application Ser. No. PCT/FI02/00089, filed on 07 Feb. 2002. Priority is claimed on that application and on the following application(s): Country: Finland, application Ser. No.: 20010243, Filed: 09 Feb. 2001.

BACKGROUND OF THE INVENTION

The present invention relates to a nozzle unit in a paper machine or finishing machine for paper. The nozzle unit is arranged to cut the processed paper web in connection with a reel change when the change takes place substantially at the normal running speed of the machine, such as in so-called Pope-type reelers and reel-ups developed from Pope-type reelers. The nozzle unit according to the invention can also be used In two-drum winders and in connection with threading in all reel-up types.

Publication EP 0543788 discloses a waterjet cutting apparatus in which a pressure of 400 to 600 bar is used. FIG. 1 in the publication shows a supporting structure, in which the nobles are arranged to move in the cross direction of the web The nozzles are connected to a control and adjustment unit that can also comprise a water container.

Publication U.S. Pat. No. 4,695,004 discloses a waterjet cutting apparatus, in which the cutting nozzles are connected to a stationary high-pressure pump by means of a flexible hose, Publication FI 99283 and the corresponding U.S. Pat. No. 5,842,664 disclose a method for cutting a wedge-shaped end during threading in a reeling device of a web-like material, such as a slitter winder.

Publication U.S. Pat. No. 3,877,334 discloses a method and an apparatus for cutting sheet material with a fluid jet. The apparatus comprises a pressure amplifier, which has small and large area pistons, and includes a fluid reservoir for a cutting fluid. A pressurizing fluid, which is led through a hydraulic conduit, energizes the cutting fluid.

In a paper machine the change of the reel spool must be conducted successfully at the same time when the paper web is run at a speed which is at least 1500 m/min. The change refers to the event in which the paper web guided on a paper reel that is becoming full is changed to be reeled around a new, empty reel spool. Because the change takes place at high speed, substantially at the normal running speed, this makes high demands on the cutting of the paper web in connection with the change of the reel spool. The paper web must be cut rapidly, because the length of the waste paper produced in the cutting is determined by the relation of the running speed with the cutting speed. When the paper web Is cut as the web is moving at the running speed and the cutting member is moving in the cross-direction of the paper web, a wedge is produced in the cutting, which wedge should form an angle not larger than 45° with the cross-direction of the paper web, because otherwise too large an amount of waste paper is produced and the new paper reel starts to bend during reeling in such a manner that a clear protrusion occurs in the paper reel reeled on the reel spool. It has to be possible to accelerate the cutting end rapidly.

Generally cutting by means of liquid, typically waterjet cutting, is implemented with a pressure of 300 to 1000 bar. Problems are caused by the solid structures required by the high-pressure cutting, which are difficult to move. Moving is difficult, because the high-pressure hoses are stiff and require large bending radii. When lighter structures are used, there is a danger that the connectors may leak and the hoses may break. In waterjet cutting, problems are also caused by the eroding effect of water, wherein both the nozzle and the pressure pump wear rapidly.

SUMMARY OF THE INVENTION

In the nozzle unit according to the invention the aforementioned problems have been reduced The device according to the invention Is characterized in that the movable nozzle unit comprises a high-pressure pump.

The advantage of the device according to the invention is that it is possible to use a low-pressure liquid all the way to the nozzle unit, wherein the durability of hoses as well as the connectors can be controlled more easily. The nozzle unit can also be moved rapidly in the cross-machine direction.

The nozzle unit according to the Invention comprises a nozzle that endures high pressure and a high-pressure pump that supplies cutting liquid at high pressure to the nozzle. The nozzle and the high-pressure pump are advantageously located close to each other in such a manner that the high-pressure supply pipes for the cutting liquid are as short as possible.

The high-pressure pump produces a positive pressure of over 1000 bar when compared to normal air pressure, typically a positive pressure of over 1500 bar The high-pressure pump can be for example a three-cylinder radial piston pump.

The hole in the nozzle has such a shape that the water sprayed therefrom is directed to a surface that is cut in a relatively point-like manner. Thus, the inner side of the nozzle can be shaped for example into a funnel-shaped form, wherein the nozzle has in the incoming direction of liquid a cylindrical and a conical section followed by a cylinder that leads to the hole in the nozzle, said cylinder being narrow and relatively long when compared to the preceding sections.

The cutting liquid can be arranged to flow from a container by means of a low-pressure pump, or the liquid may be taken for example directly from a water distribution system. Before the high-pressure pump there may be necessary auxiliary devices, such as a low-pressure pump, a filtering unit for liquid or a valve that outs off the supply of liquid. The filter of the filtering unit and the auxiliary devices of the same may be located either in a moving part or in a stationary part, advantageously, however, in a stationary part. Between the high-pressure pump and the nozzle there may be for example a pressure sensor and a pressure adjustment valve. The high-pressure pump is controlled by the control unit in a synchronized manner with respect to the other functions of the paper machine so that the starting and finishing of spraying of liquid correspond to the need for cutting.

As for the cutting liquid, it is possible to use a liquid suitable for cutting, such as water, paraffin oil, or an emulsion made of these, wherein the necessary lubrication is attained for the nozzle.

BRIEF DESCRIPTION OF THE DRAWINGS

In the following, the invention will be described by means of drawings, in which.

DETAILED DESCRIPTION OF THE PRESENTLY PREFERRED EMBODIMENTS

Figure 1:
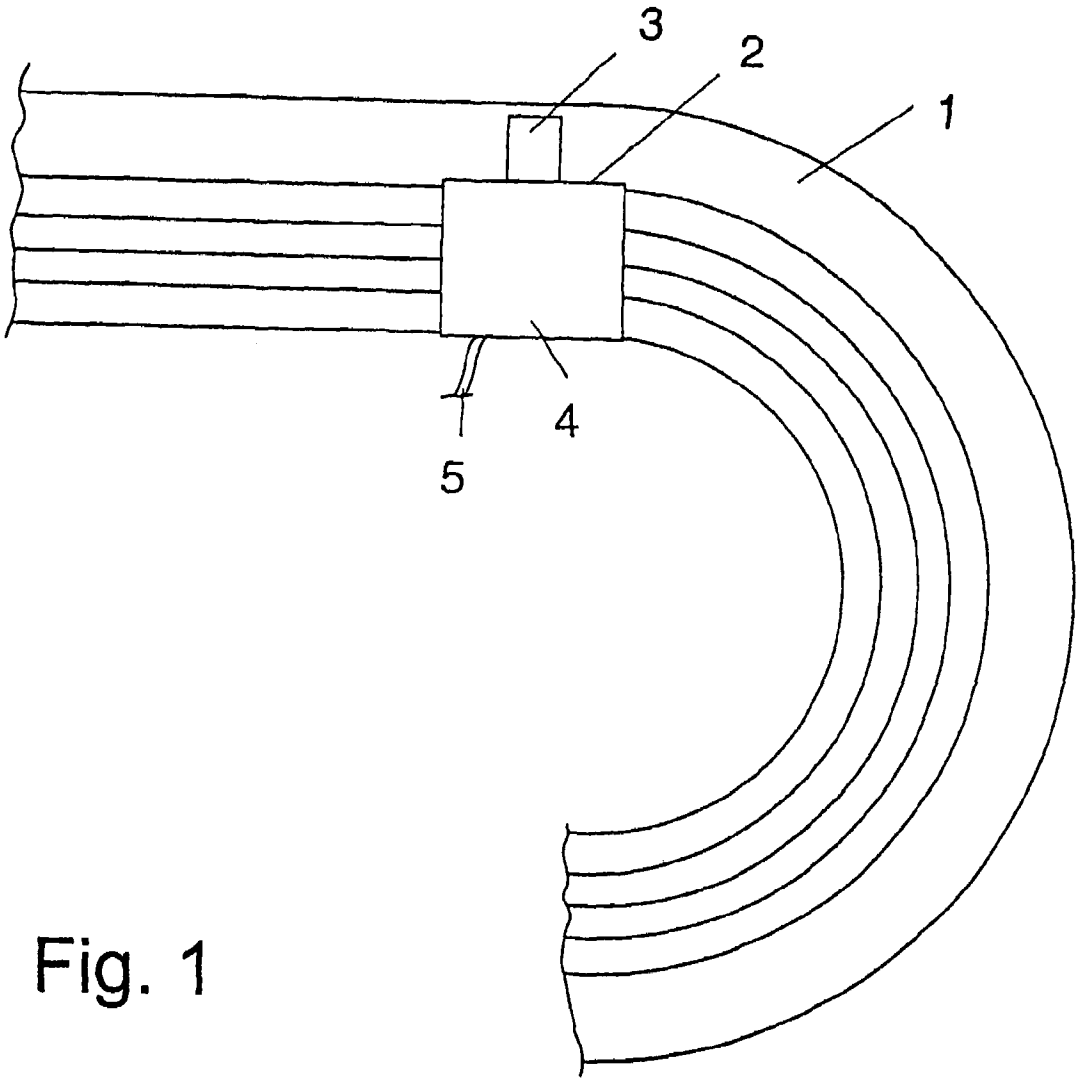
FIG. 1 shows a part of a solution for the device according to the invention in a top view.

FIG. 1 shows a solution for the device according to the invention. The nozzle unit 2 travels on the periphery of an endless guide line 1 having a rectangular shape with rounded corners, by means of rollers or the like. The guide line 1 may have two parts in such a manner that the guides guiding the nozzle unit 2 are positioned both above and below the nozzle unit 2 (shown in FIGS. 2*b* to 4*b*). FIG. 1 only shows the guide line underneath the nozzle unit 2. The nozzle unit 2 comprises a nozzle 3 and a high-pressure pump 4 integrated in the nozzle unit 2. The cutting liquid is conducted to the high-pressure pump 4 via a hose 5. The other end of the hose is commented to a source of the cutting medium, such as a water distribution system or a liquid container. The cutting liquid in the hose 5 is in a low-pressure state so that it is, however, possible to supply the necessary amount of liquid to the nozzle 3.

Figure 5:
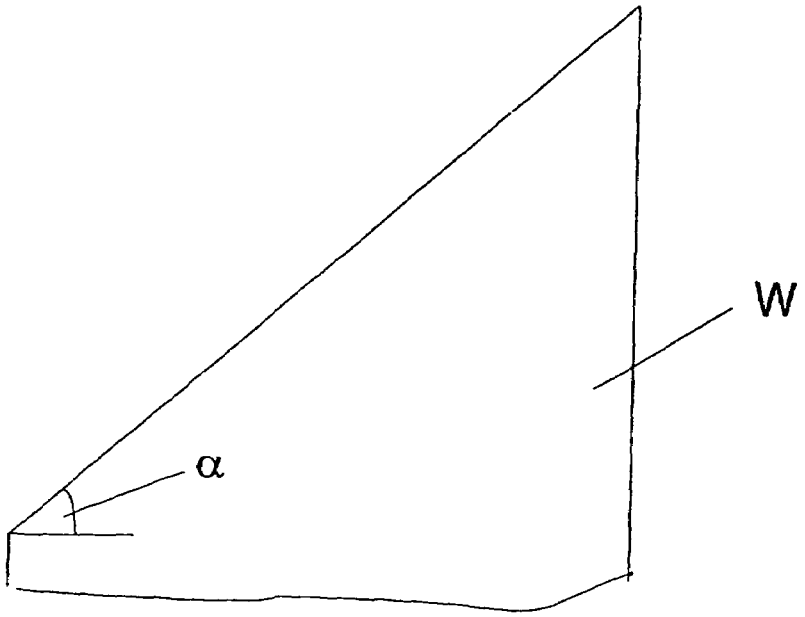
FIGS. 5 to 7 show the cut end of the web when it is cut by means of the device according to the invention.
Figure 6:
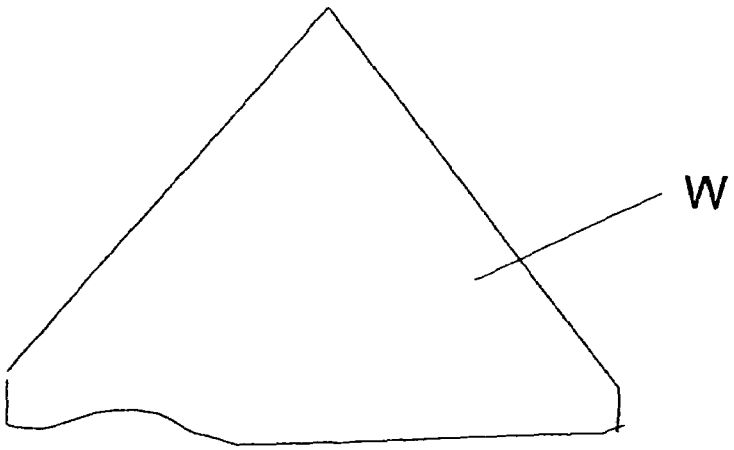
Figure 7:
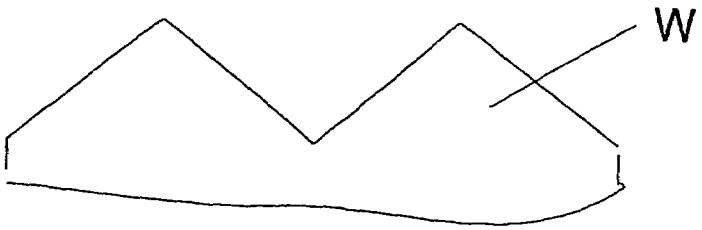

FIGS. 2 to 4 show different embodiments of tile device according to the invention, and FIGS. 5 to 7 show the cut end of the web when the web has been cut with the device according to the invention.

Figure 2A:
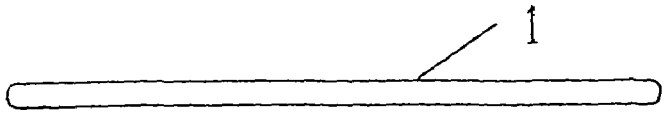
FIGS. 2 to 4 show different embodiments of the device according to the invention (FIG. a) from the top and FIG. b) from the side)
Figure 2B:
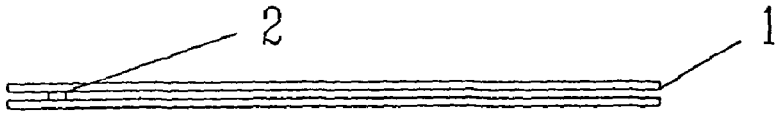
Figure 3A:
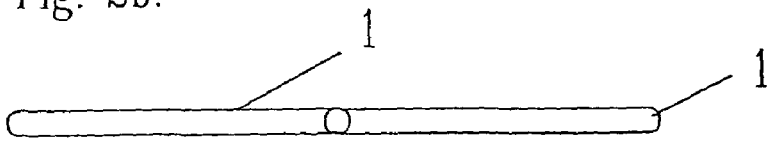
Figure 3B:
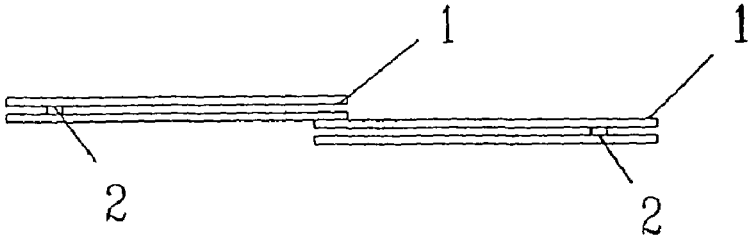
Figure 4A:
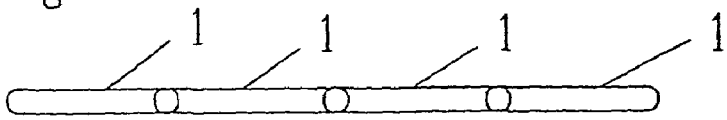
Figure 4B:
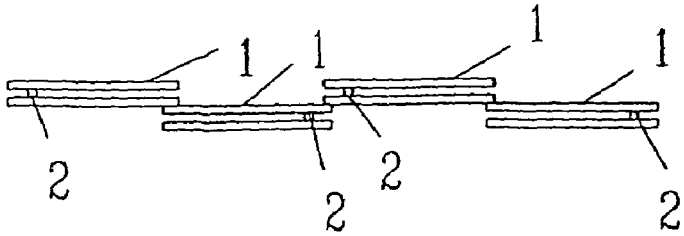

FIG. 2*a* shows the guide line 1 from the top. FIG. 2*b* shows the same guide line 1 in a side view. The guide line 1 comprises guides above and underneath the nozzle unit 2, the nozzle unit 2 moving under the guidance of said guides. In the arrangement according to FIGS. 2*a* and 2*b* the cutting takes place by means of one nozzle unit, wherein an end of the web W shown in FIG. 5 is produced. FIG. 5 shows the wedge produced in the cutting, wherein the angle a formed by the wedge with the cross direction of the paper web should advantageously be not larger than 45°.

FIGS. 3*a* to 4*b* show embodiments that correspond to FIGS. 2*a* and 2*b* in other respects, but contain, however, several guide lines 1 and nozzle units 2 instead of one guide line 1. The nozzle units 2 are arranged in pairs so that the pairs move towards each other along the guide lines 1 in the cross direction of the web W. The guide lines 1 are positioned vertically on different levels with respect to each other, because it has to be possible for the nozzle units 2 to travel freely on the guide line 1 of their own By means of the arrangement according to FIGS. 3*a* and 3*b*, an end of the web W according to FIG. 6 is produced. By means of the arrangement according to FIGS. 4*a* and 4*b* an end of the web W shown in FIG. 7 is produced.

The invention is not restricted to the description above, but it may vary within the scope of the claims. The main aspect in this invention is that the nozzle unit that is arranged to be movable comprises a nozzle and a high-pressure pump, wherein high-pressure pumps do not have to be moved, but the entire nozzle unit is moving.

What is claimed is:

1. A device for cutting a web with a liquid medium comprising:

a nozzle unit movably mountable on a guide line, said nozzle unit comprising:

a nozzle having an output hole directed toward the web, and an input aperture in fluid connection with the output hole;

a pump capable of increasing a pressure of a liquid medium supplied substantially at atmospheric pressure to the pump to a pressure over 1000 bar, an output of the pump being in fluid connection with the input aperture of the nozzle so that pressurized fluid leaving the pump enters the nozzle to be ejected from the output hole of the nozzle, an input of the pump being in fluid connection with a continuous source of the liquid medium, the pump operating to increase the pressure of the liquid medium supplied thereto without the use of a pressurizing fluid different than the liquid medium, wherein the liquid medium is water, paraffin oil or an emulsion thereof; and a guide line extending across at least a portion of a width of a web, the guide line having a rectangular shape with rounded corners, the nozzle unit being movably mounted on to a periphery of the guide line so as to be capable of moving across at least a portion of the width of the web.

2. The device of claim 1, wherein the pump increases the pressure of the liquid medium by over 1500 bar.

3. A method for cutting at least a portion of a width of a moving paper web with the device of claim 1, comprising:

feeding the liquid medium to the pump;

activating the pump; and directing the output hole of the nozzle toward the moving paper web.

4. The method claim 3, wherein the pump increases the pressure of the liquid medium by over 1500 bar.

* * * * *